US006739897B1

(12) United States Patent
Chang

(10) Patent No.: US 6,739,897 B1
(45) Date of Patent: May 25, 2004

(54) ELECTRICAL CONNECTOR WITH DISTRIBUTION CONTACTS

(75) Inventor: Che-Chia Chang, Taipei (TW)

(73) Assignee: Comax Technology Inc., Taipei (JP)

( * ) Notice: Subject to any disclaimer, the term of this patent is extended or adjusted under 35 U.S.C. 154(b) by 0 days.

(21) Appl. No.: 10/291,623

(22) Filed: Nov. 12, 2002

(51) Int. Cl.[7] ..... H01R 4/24; H01R 4/26; H01R 11/20

(52) U.S. Cl. ..... 439/404

(58) Field of Search ..... 439/404, 389, 439/391, 395, 397, 399, 367

(56) References Cited

U.S. PATENT DOCUMENTS 4,834,670 A * 5/1989 Rodondi et al. ..... 439/398
5,249,980 A * 10/1993 Hatagishi ..... 439/398
5,338,220 A * 8/1994 Soes et al. ..... 439/403
6,062,895 A * 5/2000 Lin et al. ..... 439/404
6,361,353 B1 * 3/2002 Saka et al. ..... 439/405
6,416,349 B1 * 7/2002 Lee ..... 439/404
6,494,750 B2 * 12/2002 Morita et al. ..... 439/752

* cited by examiner

*Primary Examiner*—Chandrika Prasad
(74) *Attorney, Agent, or Firm*—Troxell Law Office PLLC

(57) ABSTRACT

The connector of the present invention has at least one contact plate or a plurality of contact plates, wherein one end of each contact plate has a plurality of terminals or pins and another end has a connection section. Because the pins carry the same voltage and are connected together, the total voltage or current capacity of the contact plate increased. Since the terminals or pins are connected to form a contact plate, only one single wire is required to be connected to a contact plate that distributes the signal or voltage of the wire to a plurality of pins instead of a wire or jumper connecting to each of the desired pins as in the conventional method.

5 Claims, 8 Drawing Sheets

ELECTRICAL CONNECTOR WITH DISTRIBUTION CONTACTS

BACKGROUND OF THE INVENTION

1. Field of The Invention

The present invention relates generally to an electrical connector. More particularly, the present invention relates to an electrical connector with distribution contacts.

2. Description of Related Art

Present-day society increasingly relies on computers, computer systems, computer software applications and computer devices as computers become more essential in everyday life. With the increasing demands of computer applications in various areas, the utility and usefulness of computers increase, and integrated circuit (IC) connection become more complex. Various techniques have been developed to increase the number of IC device connections while providing a more compact computer with high performance.

Device such as hard disk drives or CD-ROM drives or peripherals such as printers or external mass storage devices are connected to a host computer by cables, these cables have connectors and contacts attached to the wires in the cable.

There are common methods for connection wires to the pins of the connectors. However, these methods require considerable time and skill. For example, with some methods, during the process of attaching each wire to each pin, the temperature has to be controlled carefully so that the wire can be bonded to the pin strongly without overheating the wire. Other methods require considerable forces, and if too much force is applied, the cooper portion of the wire can be damaged or even break off. Additionally, each pin has to be connected to every wire in order to make the proper connection. In a 40 pins connector, for example, 40 individual wires need to be attached or connected to the connector contact. Therefore, making the connections is time consuming, resulting in an increased production cost.

As a result, an improved electrical connector that reduces production time, defects, and lower production costs is needed.

SUMMARY OF THE INVENTION

It is an object of the present invention to provide a more compact, reliable and cost-effective connector by utilizing an improved connector with improved connection and contacts.

The previous example describes a one wire to one contact connecter where each contact is attached to only on wire. In some situations a wire or a plurality of wires must be connected to a plurality of contacts or pins of the connector. This can be accomplished by connection jumpers between the plurality of contacts. However, this increases the production time and increases the probability of a damaged or imperfect part As a result, an improved connector incorporating contacts that distribute a signal or voltage to a plurality of pins or contacts has been developed. Therefore a wire or a plurality of wires can be connected to a plurality of pins of the connectors without requiring jumpers to make the connection.

Both the foregoing general description and the following detailed description are exemplary and explanatory only and are not restrictive of the invention, as claimed.

BRIEF DESCRIPTION OF THE DRAWINGS

The present invention can be more fully understood by reference of the following description and accompanying drawings, in which.

DETAILED DESCRIPTION OF THE PREFERRED EMBODIMENTS

It is an object of the present invention to provide a more compact, reliable and cost-effective connector by utilizing a connector with improved connections and contacts allowing a wire or wires to be electrically connected to a plurality of contact pins or points.

The previous example describes a one wire to one contact connector where each contact is attached to only one wire. In some situations a wire or a plurality of wires must be connected to a plurality of contacts or pins of the connector. This can be accomplished by connection jumpers between the plurality of contacts. However, this increases the production time and increases the probability of a damaged or imperfect part As a result, an improved connector incorporating contacts that distribute a signal or voltage to a plurality of pins or contacts has been developed. Therefore a wire or a plurality of wires can be connected to a plurality of pins of the connectors without requiring jumpers to make the connection.

Figure 1:
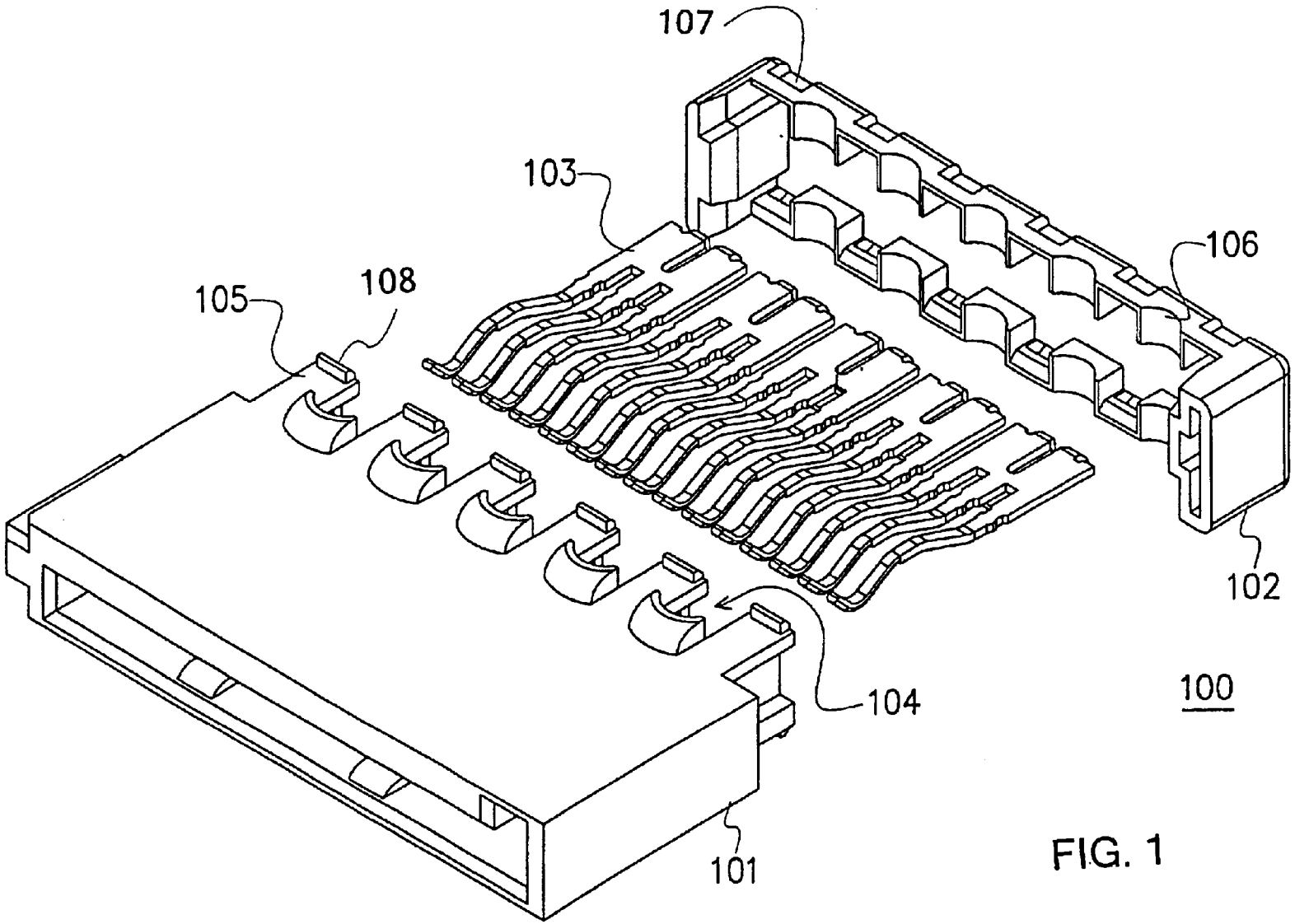
FIG. 1 is an assembly view showing a connector with distribution contacts in accordance with an embodiment of the present invention.

Referring to FIG. 1, which illustrates an assembly view of a connector in accordance with an embodiment of the present invention. The connector 100 comprises: a housing 101, a cover 102 and a contact plate 103. The housing 101 has a plurality of slots 104 that are used to insert wires into and a plurality of first protrusions 105, and having a protrusion portion 108 on the first protrusions 105. The first protrusions 105 are arranged in such a way so as to be separated from each other by the slots 104 to form a finger-like structure. The cover 102 is disposed on one side of the housing 101, both sides of the cover 102 have a fastener structure that constitute with the protrusions 108 of the housing 101 and a plurality of concave surfaces 106.

Location of the concave surfaces 106 and the cover 102 are matched and correspond to positions of the slots 104 of the housing 101. The housing 101, cover 102, 102*a*, 102*b*, 102*c* and contact plate 103 are examples and do not limit the housing 101, cover 102, 102*a*, 102*b*, 102*c* and contact plate 103 of the present invention to those types shown. Various other types of housing 101, cover 102, 102*a*, 102*b*, 102*c* are also envisioned depending on the size and number of pins required.

During an integrating process, at least one contact plate 103 is inserted into the housing 101, and the cover 102 is integrated onto a part of the housing 101. For example purpose, FIG. 1 shows five contact plates 103 but the numbers of contact plates 103 can be increased or decreased as determined by the number of contact plates 103 required by the connector.

Figure 2:
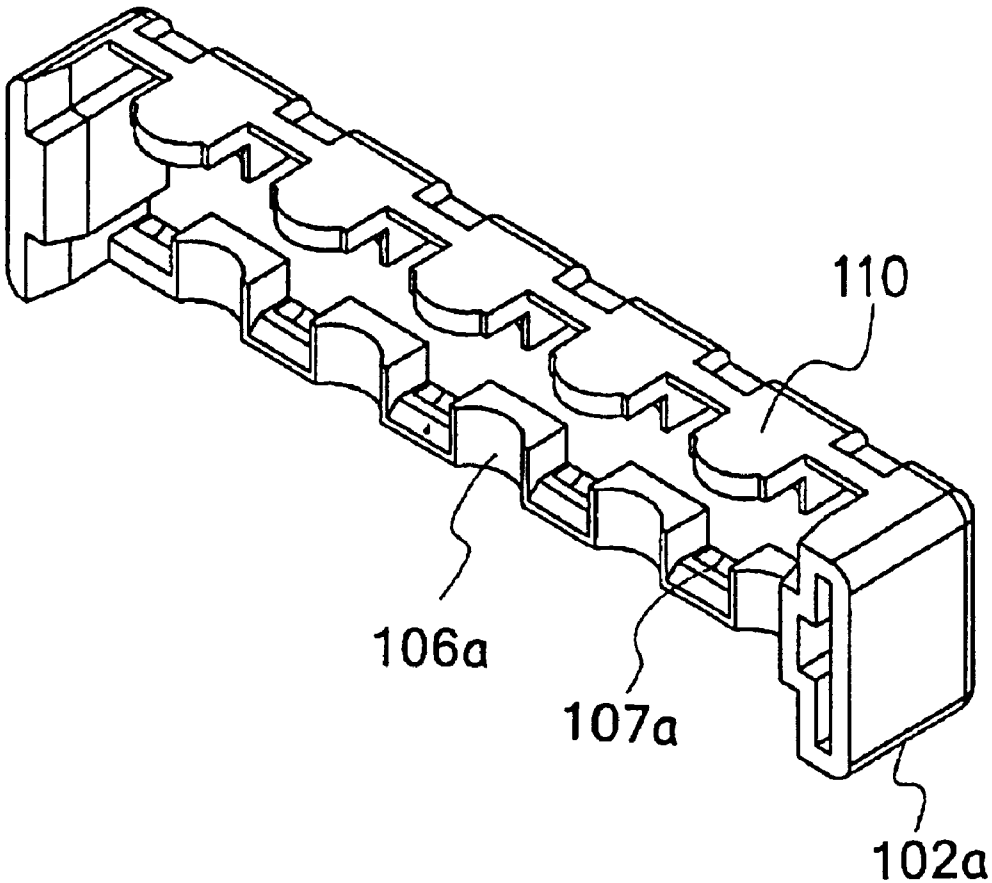
FIG. 2 is an assembly view of another cover in accordance with an embodiment of the present invention.
Figure 3:
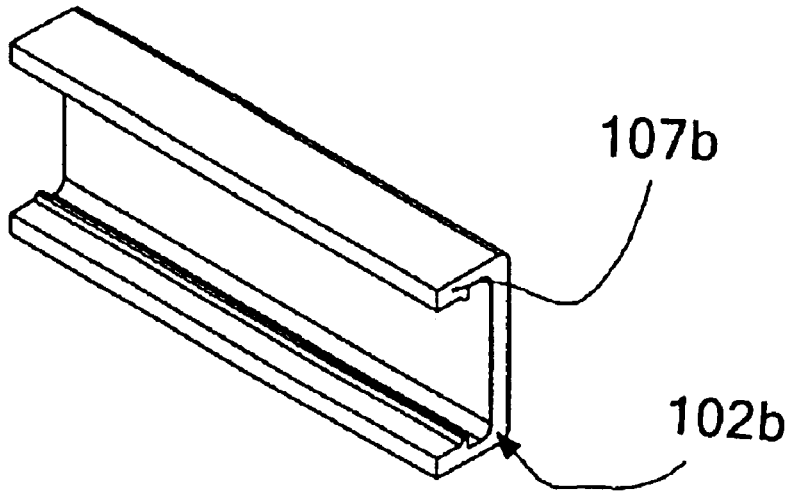
FIG. 3 is an assembly view of the other cover in accordance with an embodiment of the present invention.
Figure 4:
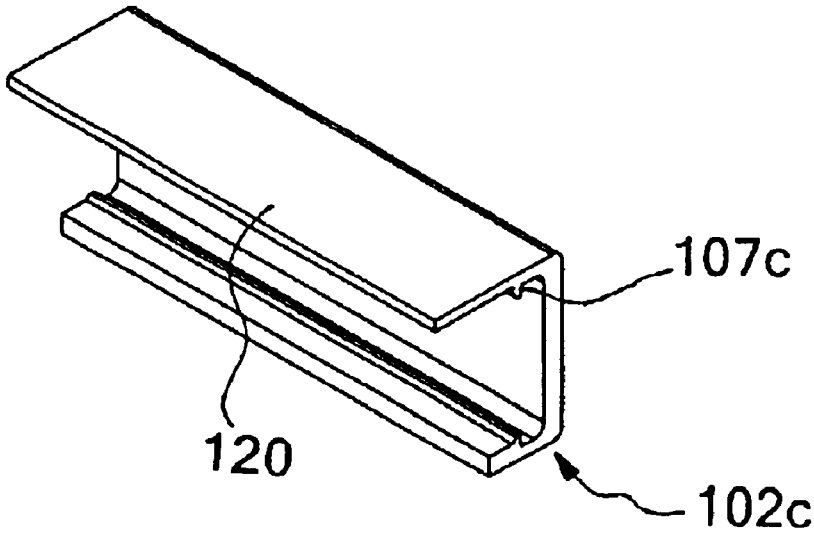
FIG. 4 is an assembly view of yet the other cover in accordance with an embodiment of the present invention.

Referring to FIG. 2, which illustrates an assembly view of another cover in accordance with an embodiment of the present invention. As shown in FIG. 2, the concave surfaces 106 of the cover 102 (shown in FIG. 1) have been replaced by a plurality of second protrusion structure 110 (shown in FIG. 2). Locations of the plurality of second protrusion structure 110 of cover 102*a* are matched and correspond to the positions of the slots structure of the housing 101, the shapes of the second protrusion structure 110 and the shapes of the slots structure are matched each other. Please refer to FIG. 3, two sides of the cover 102*b* can only be placed a fastener structure 107*b* as required without the concave surfaces 106 of the cover 102 (shown in FIG. 1), in order to make the cover 102 engage to the protrusion portion 108 of the housing 101 directly, additionally, Please refer to FIG. 4, two sides of the cover 102*c* can be placed a fastener structure 107*c* as required, and one side of the cover 102*c* can be placed a blocking plate 120 that can shield the slots structure 104 of the housing 101.

Figure 5:
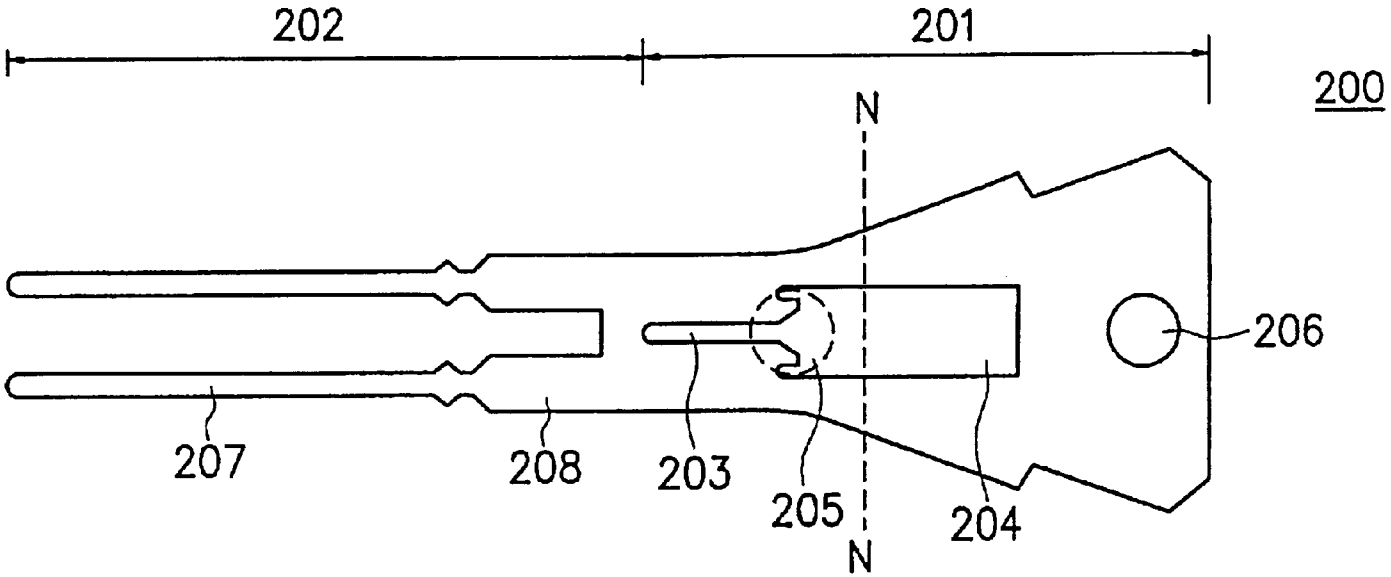
FIG. 5 is a drawing showing a contact plate of a connector in accordance with an embodiment of the present invention.

FIG. 5 is a drawing showing a contact plate of a connector in accordance with an embodiment of the present invention. Referring to FIG. 5, the contact plate 200 comprises a top portion 201 and a forked portion 202.

The top portion 201 comprises an oblong-shaped slot, which is an insulation displacement contact (IDC) section 203 extending into a wider hole 204 via a Y-shaped transition portion 205. The circular hole 206 is for positioning the contact plate during a fabrication process. In an integrating process, the top portion 201 will be broken off along a line N—N.

A standard insulated wire can be inserted into the IDC section 203. The wire is inserted through the Y-shaped transition portion 205 into the IDC section 203.

Figure 6:
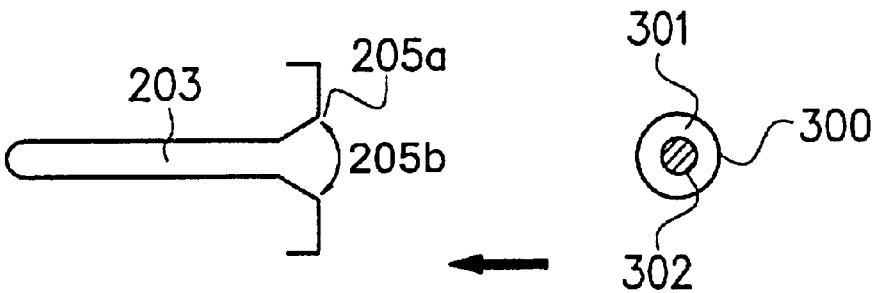
FIG. 6 is a magnified view showing a portion of a contact plate shown in FIG. 5, in accordance with an embodiment of the present invention.

FIG. 6 illustrates a magnified view showing a portion of the contact plate according to an embodiment of the present invention. Referring to FIG. 6, The Y-shaped transition portion 205 comprises a pair of sharp edges 205*a* and a Y-shaped opening 205*b*. A distance between the sharp edges 205*a* is smaller than an outer diameter of the conductive wire portion 302 contained in the wire 300. When the wire 300 is inserted into the Y-shaped opening 205*b*, the sharp edges 205*a* will cut through an insulating portion 301 of the wire 300, and a conductive wire portion 302 of the wire 300 is exposed and comes into contact with the IDC section. The Y-shaped transition portion 205 is designed in such way that it allows is the wire to electrically connect to the terminals without soldering or crimping and without any damage to the conductive wire portion 302 of the wire 300.

Referring again to FIG. 5, the forked portion 202 of the contact plate 203 comprises two conducting terminals, pins or leads 207, which are connected at one end into a contact part 208, thus forming a fork-shaped structure. The conductive terminals, pins or leads 207, can be made of, for example, cooper alloy for good conductivity.

After the wire is connected to the contact plate, any signal or voltage level that pass through the wire, is distributed to a plurality of contact pins or terminals of the connector. In this way, a wire or a plurality of wires can be connected to a plurality of pins of the connector without requiring jumpers to make the multiple connections. In the conventional method a wire is attached to a first contact. Then one end of a jumper is connected to the wire or first contact. Finally, the other end of the jumper is connected to the second contact. This requires 3 connecting steps during the manufacturing process. However, with the present invention, only one connection is required where the wire is connected to the contact pad and the contact pad distributes the signal to the appropriate contact terminals or pins.

The connector of the present invention comprises at least one contact plate or a plurality of contact plates, wherein one end of each contact plate has a plurality of terminals or pins, such as two pins, for example, and another end has a connection section. Each pin can carry a signal, current or voltage, for example 3V,5V,or 12V. The pins that carry the same signal, current or voltage are then combined together into one contact plate. Because the pins carry the same voltage and are connected together, the total voltage or current capacity of the contact plate is increased. Since the pins are connected to form a contact plate, only one signal wire is required to connected to a contact plate inserted of every wire connection to every pin as in the conventional method. Therefore, the number of wire connections is reduced.

The contact plate of the present invention is not limited to the number of conducting forked structures in each contact plate. Also, the number of contact plates can be combined into more two conducting structures.

Figure 7:
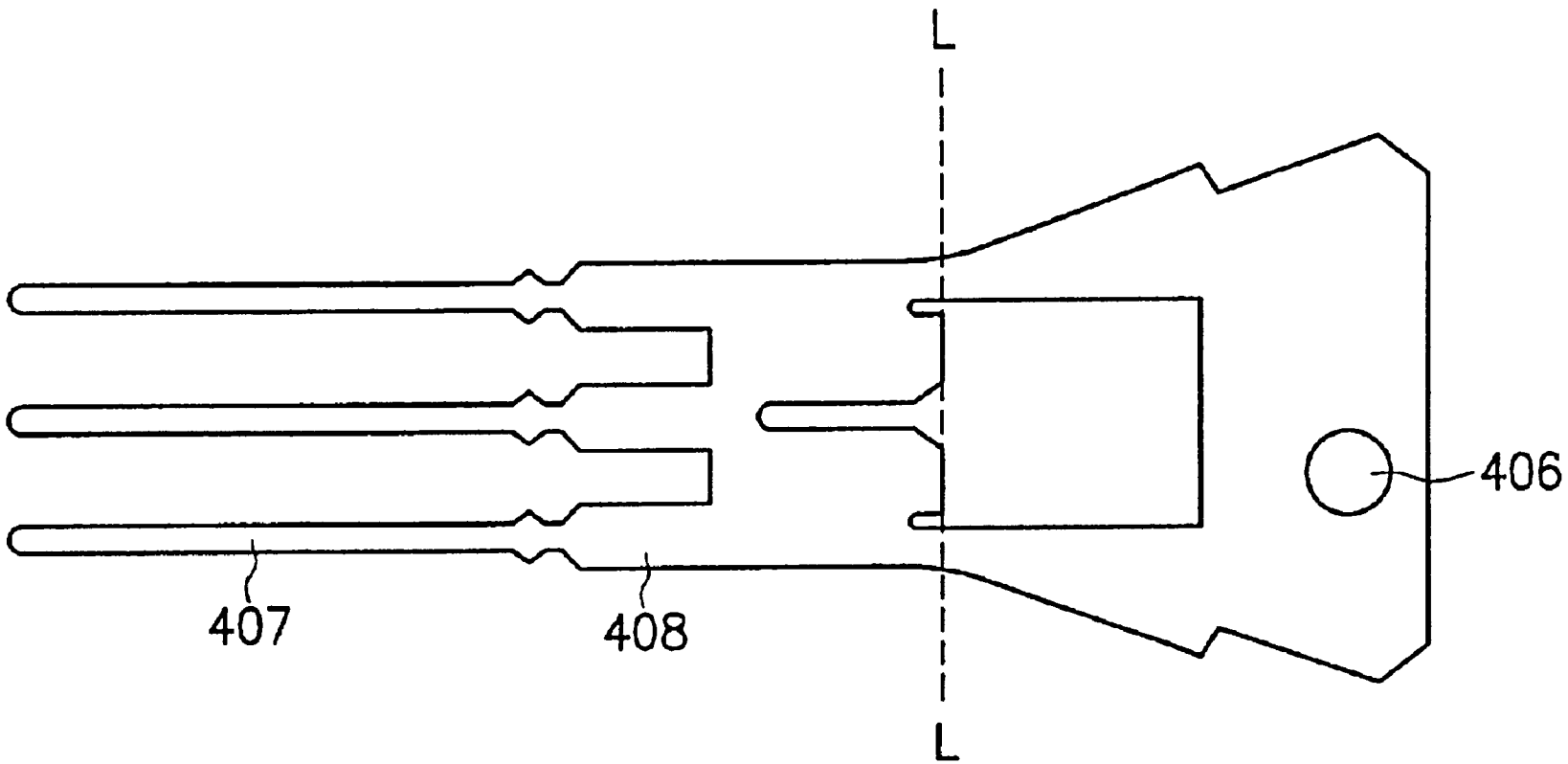
FIG. 7 is a drawing showing a distribution contact plate of a connector in accordance with an embodiment of the present invention.

FIG. 7 illustrates a contact plate of a connector with distribution contact in accordance with an embodiment of the present invention. Based on the same principles and theory, a contact plate comprises three terminals or pins 407 are shown. The number of terminals or pins can be any quantity and is not limited to two or three as shown in the drawings. In fact, as shown above, increasing the number of terminals or pins increases the value of the present invention. The present invention only requires one connection per contact pin in order to distribute a signal or voltage to a plurality of pins. However, with the conventional method, if a signal is to be sent to four pins a total of seven connections are required.

Figure 8:
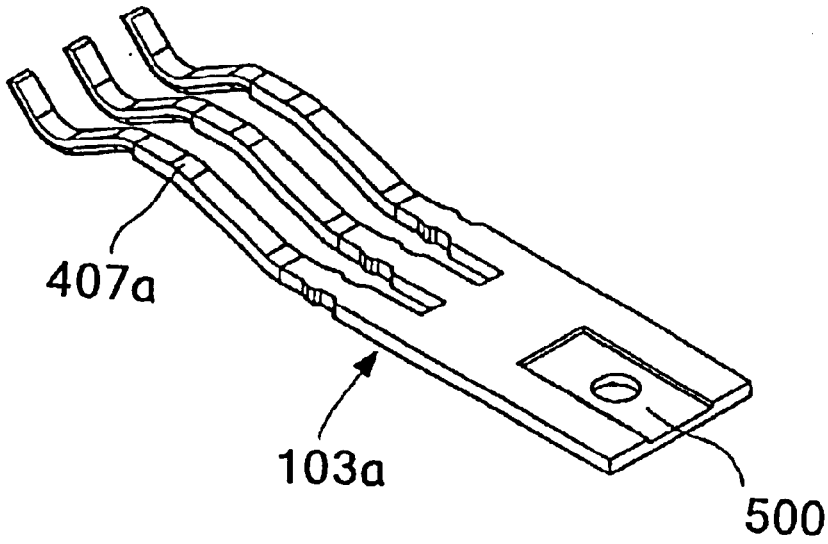
FIG. 8 is a drawing showing a solder-able contact plate of a connector in accordance with an embodiment of the present invention.
Figure 9:
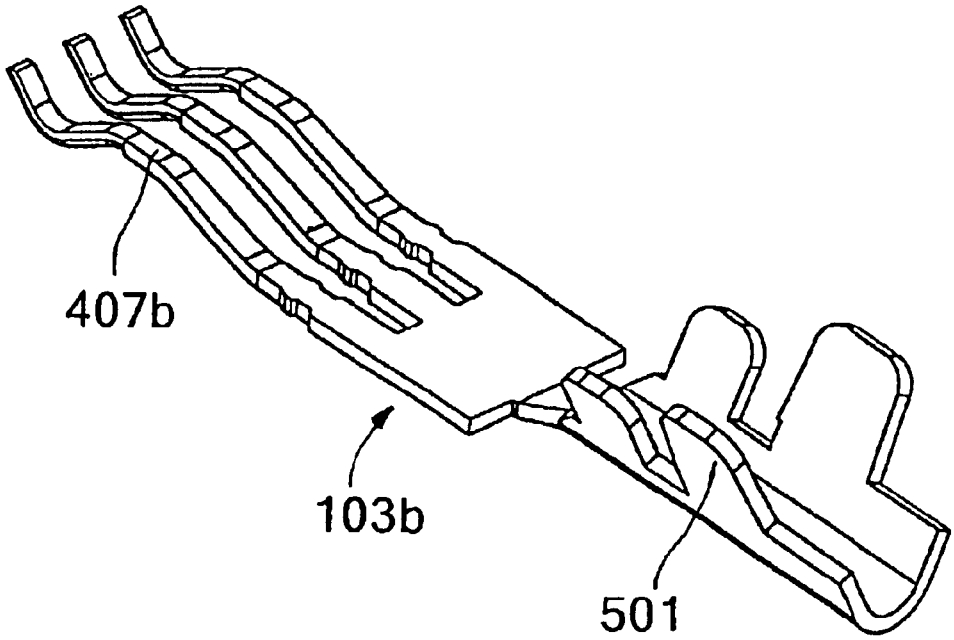
FIG. 9 is a drawing showing a crimp-able contact plate of a connector in accordance with an embodiment of the present invention.

In previous embodiments, connections between the wire or a plurality of wires and pins or terminals are made by IDC method. However, In other embodiments of the present invention, the IDC method can be substituted by soldering, crimping or other connection methods. Two possible methods are shown in FIG. 8 and FIG. 9. Please refer to FIG. 8, which illustrates a structure view of a solder-able contact plate in accordance with an embodiment of the present invention. The contact plate 103*a* has a soldering portion 500 located at an opposite end of the pin 407*a*, wherein a wire or a plurality of wires can be soldered to the soldering portion 500 of the contact plate 103*a*. Please refer to FIG. 9, which illustrates a structure view of a crimp-able contact plate in accordance with an embodiment of the present invention. The contact plate 103*b* has a crimping portion 501 located at an opposite end of the pin 407*b*, wherein a wire or a plurality of wires can be connected to the crimping portion 501 of the contact plate 103*b* by crimping method.

Figure 10:
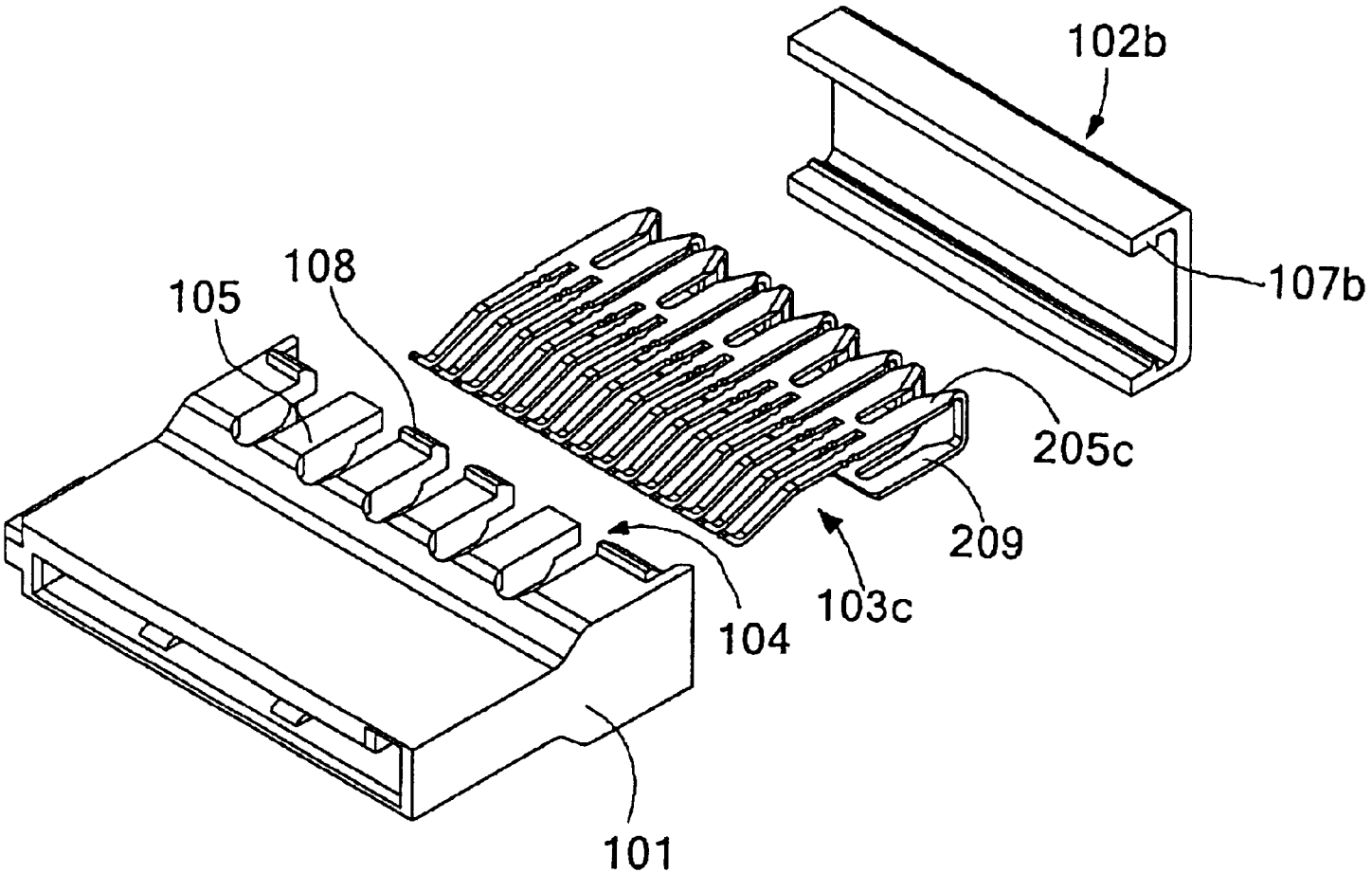
FIG. 10 is an assembly view showing a connector with distribution contacts in accordance with an alternative embodiment of the present invention.
Figure 11A:
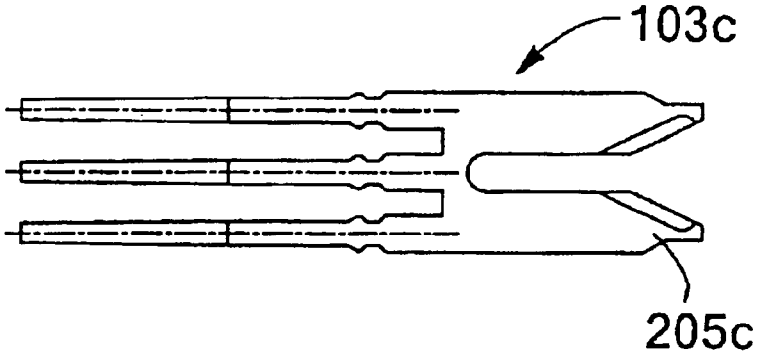
FIG. 11*a* and 11*b* is a lateral view showing a contact plate of a connector in accordance with an alternative embodiment of the present invention.
Figure 11B:
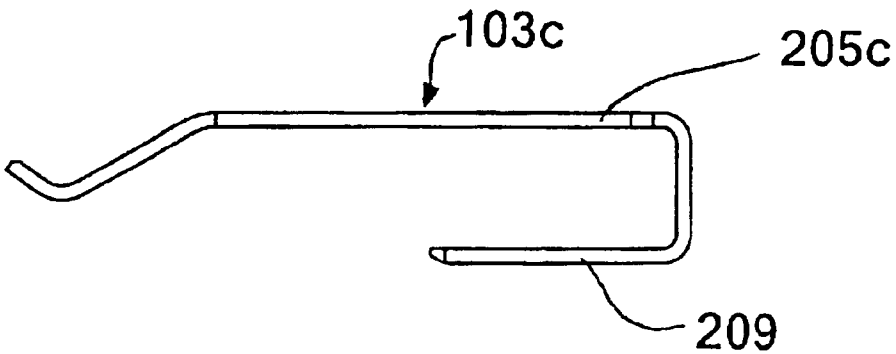

Additionally, in order to improve the performance of the electrically connect of the contact plate and wire, please refer to FIG. 10, FIG. 11*a* and 11*b*, wherein the free end of the first Y-shaped transition portion 205*c* of the contact plate 103*c* is extended and folded back such that to generate a second Y-shaped transition portion 209 that parallel to the first Y-shaped transition portion 205*c*. As a result, increasing the contact area of the wires that are inserted into, and ensuring the electrically connect of the contact plate 103*c* and wires.

Advantages of the present invention are at least:

1. The number of connections that are required is reduced, therefore, less time is required arid the cost is reduced.
2. The total voltage or current capacity of the contact plate is greatly increased.
3. The connection between wires or pins or wires to wires is more effective and rapid no damage occurs to the conductive portion of the wire.
4. The cost of production is significantly reduced, and the integrating process and fabrication process are simplified.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. An electrical connector with a distribution pin or pins, wherein the connector is connected to a wire or wires to form an electrical channel, comprising:

a) a housing having a plurality of first protrusions on one end, the first protrusions being spaced apart so as to define a plurality of slots therebetween, each of the plurality of first protrusions has one protrusion portion;

b) at least one contact plate positioned in the housing, the at least one contact plate having:

i) a first end with a fork-shaped portion having at least two contact terminals; and ii) a second end including a first Y-shaped transition portion with an insulation displacement contact and a second Y-shaped transition portion with an insulation displacement contact, the second Y-shaped transition portion is parallel to the first Y-shaped transition portion, the first Y-shaped transition portion is located between the fork-shaped portion and the second Y-shaped transition portion, such that the wires are connected to the insulation displacement contacts through the housing; and c) a cover having two fastening structures, one fastener structure on each of two sides thereof, wherein the two fastener structures engage the protrusion portions of the plurality of first protrusions of the housing, thereby connecting the cover with the housing.

2. The connector according to claim 1, wherein the contact plate is made of a copper alloy.

3. The connector according to claim 1, wherein each of the two sides of the cover has a plurality of concave surfaces into which the wires are inserted, each concave surface is aligned with one of the plurality of slots in the housing.

4. The connector according to claim 1, wherein a first of the two sides of the cover has a plurality of concave surfaces into which the wires are inserted, and a second of the two sides has a second protrusion structure for shielding the wires.

5. The connector according to claim 1, wherein one of the two sides of the cover has a blocking plate for shielding the wires.

* * * * *